US009534490B2

(12) United States Patent
Farrag et al.

(10) Patent No.: US 9,534,490 B2
(45) Date of Patent: Jan. 3, 2017

(54) SYSTEM AND METHOD FOR DETECTING UNDERGROUND CROSS-BORES

(71) Applicants: Khalid Farrag, Streamwood, IL (US); Kiran Kothari, Hoffman Estates, IL (US)

(72) Inventors: Khalid Farrag, Streamwood, IL (US); Kiran Kothari, Hoffman Estates, IL (US)

(73) Assignee: Gas Technology Institute, Des Plaines, IL (US)

( * ) Notice: Subject to any disclaimer, the term of this patent is extended or adjusted under 35 U.S.C. 154(b) by 761 days.

(21) Appl. No.: 13/930,595

(22) Filed: Jun. 28, 2013

(65) Prior Publication Data

US 2015/0000979 A1 Jan. 1, 2015

(51) Int. Cl.

| | |
|---|---|
| ***E21B 47/09*** | (2012.01) |
| ***E21B 47/08*** | (2012.01) |
| ***E21B 41/00*** | (2006.01) |
| *E21B 7/02* | (2006.01) |

(52) U.S. Cl.

CPC ..... *E21B 47/09* (2013.01); *E21B 41/00* (2013.01); *E21B 47/08* (2013.01); *E21B 7/026* (2013.01)

(58) Field of Classification Search

CPC ..... E21B 47/08; E21B 7/26; G01B 5/12; G01B 7/13

See application file for complete search history.

(56) References Cited

U.S. PATENT DOCUMENTS

| | | | | |
|---|---|---|---|---|
| 4,694,913 | A * | 9/1987 | McDonald | E21B 4/145 175/19 |
| 2002/0166396 | A1* | 11/2002 | McGrew | G01M 3/38 73/865.8 |
| 2006/0220651 | A1* | 10/2006 | Clark | E21B 47/01 324/368 |
| 2010/0018305 | A1* | 1/2010 | Maute | E21B 47/10 73/152.29 |
| 2012/0055711 | A1* | 3/2012 | Brannigan | E21B 47/08 175/50 |
| 2014/0138084 | A1* | 5/2014 | Al-Mulhem | E21B 41/0035 166/255.1 |

* cited by examiner

*Primary Examiner* — George Gray
(74) *Attorney, Agent, or Firm* — Pauley Erickson & Kottis

(57) ABSTRACT

A system for detecting an underground cross-bore includes a mechanical sensing device attached to an underground travel element to form a combination adapted for underground travel. The mechanical sensing device senses at least a first underground condition wherein the combination is ensconced in an underground bore and a second underground condition wherein the sensing device senses entry into a pipe cavity. The mechanical sensing device desirably can provide a signal identifying entry into a pipe cavity.

1 Claim, 7 Drawing Sheets

Spring unit in soil
(spring arms are inside unit)

Spring unit in void
(spring arms are open)

SYSTEM AND METHOD FOR DETECTING UNDERGROUND CROSS-BORES

FIELD OF THE INVENTION

This invention generally relates to systems and methods for detecting underground, i.e., below ground surface, cross-bores.

DESCRIPTION OF RELATED ART

Drilling operations using trenchless Horizontal Direction Drilling (HDD) and moles are increasingly commonly being used for or in the installation of pipelines such as for natural gas distribution, for example, without the need for open trenches. Unfortunately, such operation and associated equipment can result in contact and rupture of other existing utility lines during the drilling process.

Existing utilities in the path of a new installation are commonly identified and located before the drilling operation. Most available locating technologies are focused on detecting metallic pipes or pipes buried with a tracer wire. Sewer lines, however, are generally non-metallic and are commonly not installed with tracer wires. Thus, HDD installations have been known to occur wherein a gas pipe has unintentionally been installed through a sewer line and the operator is unaware of the situation. Such an installation can create or result in a blockage in the sewer line and the sewer line cleaning process can cause damage to the gas pipe such as to result in a gas leakage through the sewer line, for example.

Several technologies exist or have been proposed to locate sewer lines before and during the installation of new pipes, including:

(a) Locating Sewer Lines Prior To New Pipe Installation:

Several commercial technologies based on Ground Penetrating Radar (GPR) are available to detect buried underground pipes. Such GPR-based technologies are typically subject to various known limitations such as relating to their use in certain soil conditions, depth of signal penetration, analysis and interpretation of the signal, and cost.

Other technologies such as acoustic technology have also been investigated to detect sewer lines. While these technologies may overcome some of the limitations associated with the GPR-based technology, they are relatively new.

(b) Locating Sewer Lines During Pipe Installation:

Several technologies, including GPR, acoustic, and capacitance tomography, have been investigated as attachments to the drilling head to detect voids during drilling new pipelines. The GPR and capacitance tomography work has primarily been directed to the inclusion of a sensor in the drill head itself while acoustic technology has commonly employed receivers at the ground to detect drill head noise being reflected by pipes. Currently, these technologies are not commercially available.

Another technology is the Cone Penetrometer Testing (CPT) technology which provides real time data to characterize the environment around the cone as it is driven into the soil. When the CPT cone is driven into the soil, the measurements of soil resistance at the tip and its friction along the cone surface are used to identify the soil type.

Thus, there is a need and a demand for systems and methods that can detect underground cross-bores, such as sewer pipes, such that a contact or hit of a sewer line and allow the operator to remedy the situation and perform corrective actions; thereby preventing future potential incidents and reducing the percentage of such hits which at least initially go undetected.

SUMMARY OF THE INVENTION

Accordingly, it is one object of this invention to provide a system and method for detecting an underground cross-bore.

This and other objects of the invention are addressed in one aspect of the invention by a system that includes a mechanical sensing device attached to an underground travel element to form a combination adapted for underground travel. The mechanical sensing device senses at least an initial underground condition wherein the combination is ensconced in an underground bore. The mechanical sensing device also senses a second underground condition wherein the sensing device senses entry into a pipe cavity. The mechanical sensing device then provides a signal identifying entry into a pipe cavity.

In particular embodiments, the apparatus can be attached to the pipe, e.g., polyethylene (PE) pipe, during pullback of the pipe after the initial drilling stage. Such a cylindrical unit can desirably be a low-cost and easy to use mechanical or spring system. Such a system can be activated when it moves from a confined soil to a cross-bore such as a void space such as a sewer pipe void; thus serving to locate such a sewer lateral and providing a real-time signal or alarm identifying a cross-bore hit.

In one specific embodiment, the cylindrical unit has arms with springs disposed around its perimeter. The arms are in a closed position when confined in soil. When the unit encounters a void space such as inside a sewer pipe, the spring arms open and an electronic signal indicating arm movement can be recorded or sent to the surface such as via a signal wire or wireless system.

In accordance with another aspect of the invention, there is provided a method for detecting an underground cross-bore. One such method involves transporting underground a combination of a mechanical sensing device attached to an underground travel element wherein the mechanical sensing device senses at least an initial underground condition wherein the combination is ensconced in an underground bore and a second underground condition wherein the sensing device identifies entry into a pipe cavity, with the mechanical sensing device providing a signal identifying entry into a pipe cavity.

BRIEF DESCRIPTION OF THE DRAWINGS

These and other objects and features of this invention will be better understood from the following detailed description taken in conjunction with the drawings, wherein.

DETAILED DESCRIPTION OF THE PRESENTLY PREFERRED EMBODIMENTS

Figure 1:
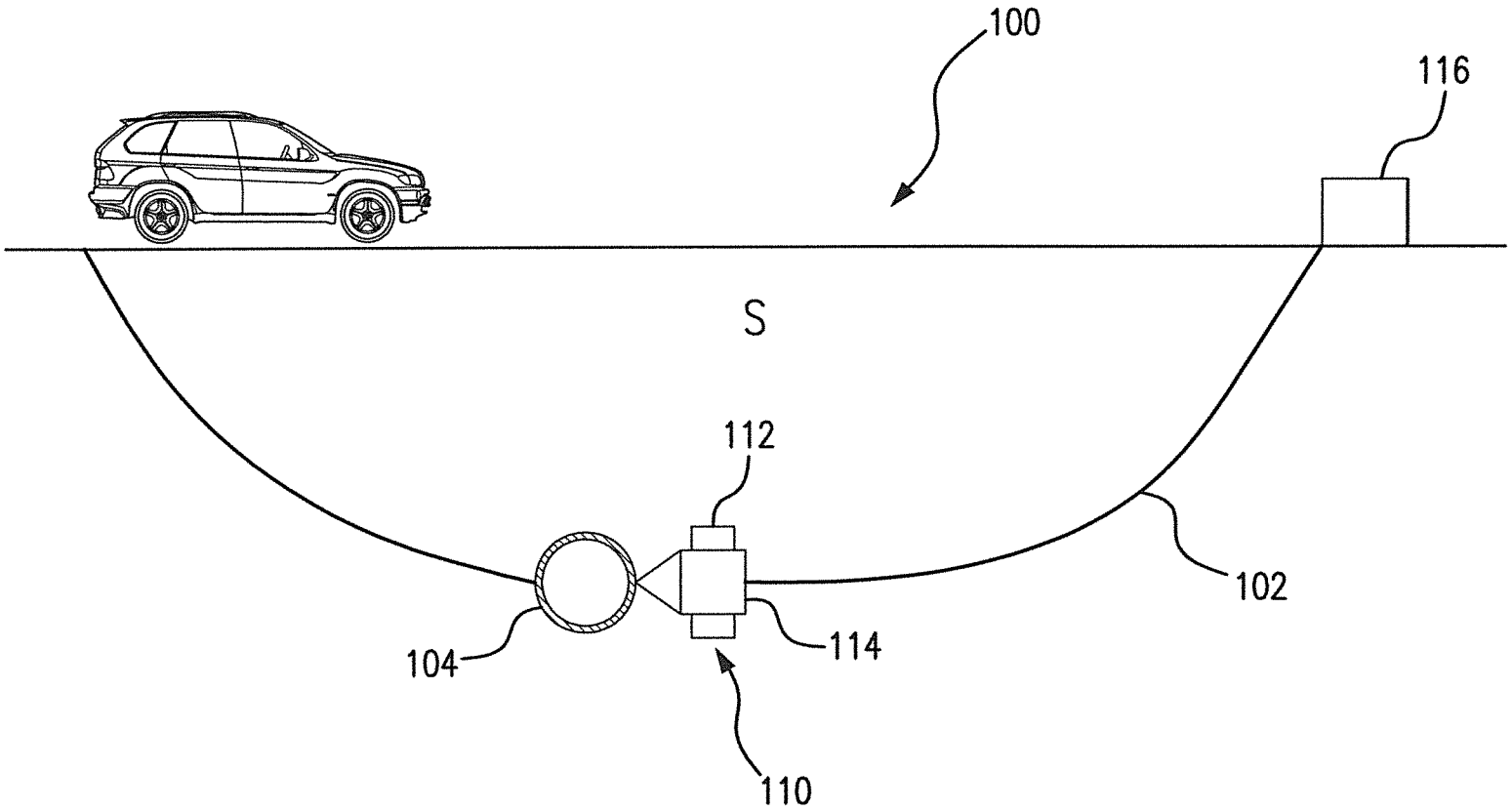
FIG. 1 is a simplified schematic diagram of an underground cross-bore detection arrangement in accordance with one aspect of the invention.

FIG. 1 shows a subsurface or underground, e.g., below the ground surface S, cross-bore detection arrangement or operation, generally designated by the reference numeral 100, in accordance with one aspect of the invention. The subsurface includes an underground bore 102 such as formed by trenchless bore drilling. The subsurface, however, also includes a cross-bore 104 such as in the form of a sewer lateral.

The underground cross-bore detection arrangement 100 involves the underground transportation of a combination 110 such as formed by a mechanical sensing device 112 attached or otherwise appropriately coupled to or with a selected underground travel element 114. As described in greater detail below, mechanical sensing devices in accordance with certain preferred aspects of the invention are effective to sense at least a first underground condition wherein the combination is ensconced in an underground bore and a second underground condition wherein the sensing device senses entry into a pipe cavity, with the mechanical sensing device providing a signal identifying entry into a pipe cavity. Further, suitable underground travel elements in accordance with selected embodiments of the invention can include, without unnecessary limitation, a drill head, a mole or a pipe, for example.

As shown the underground cross-bore detection arrangement 100 may also include an above-ground base unit 116, such as may include a receiver such as to receive signals such as provided or resulting from the mechanical sensing device 112.

Figure 2:
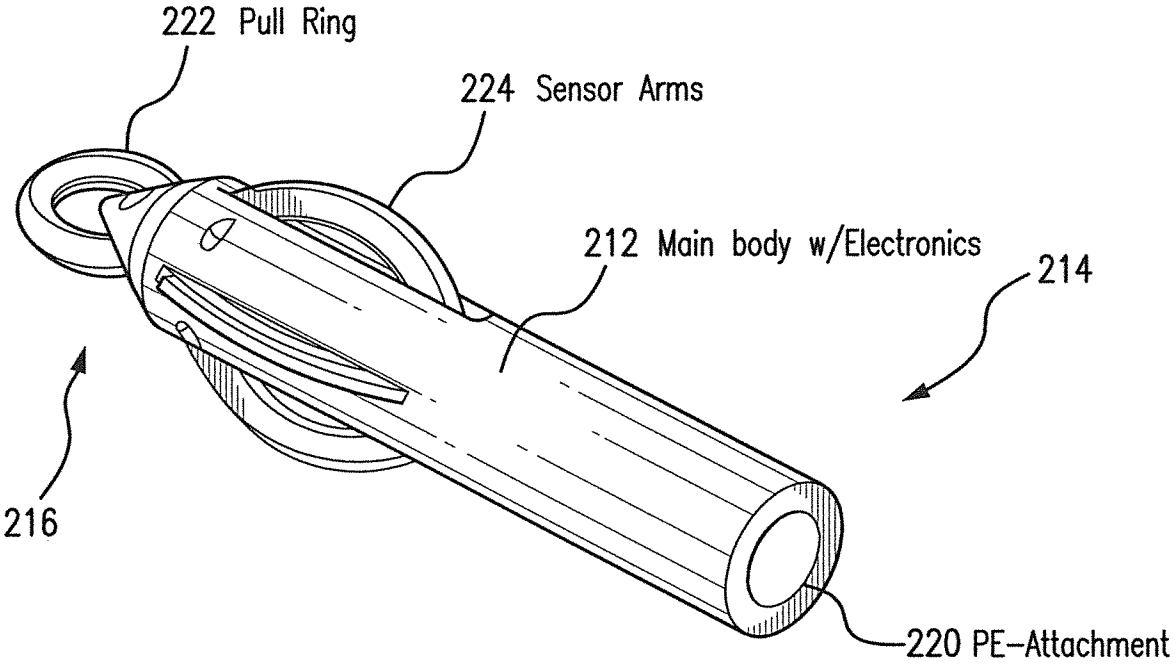
FIG. 2 is a simplified perspective view of the underground cross-bore mechanical sensing device in accordance with one embodiment of the invention.
Figure 3:
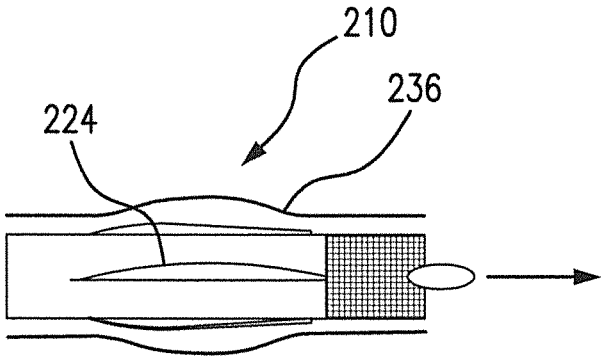
FIG. 3 is a simplified side view of the underground cross-bore mechanical sensing device shown in FIG. 2 and showing the device while ensconced in soil.
Figure 4:
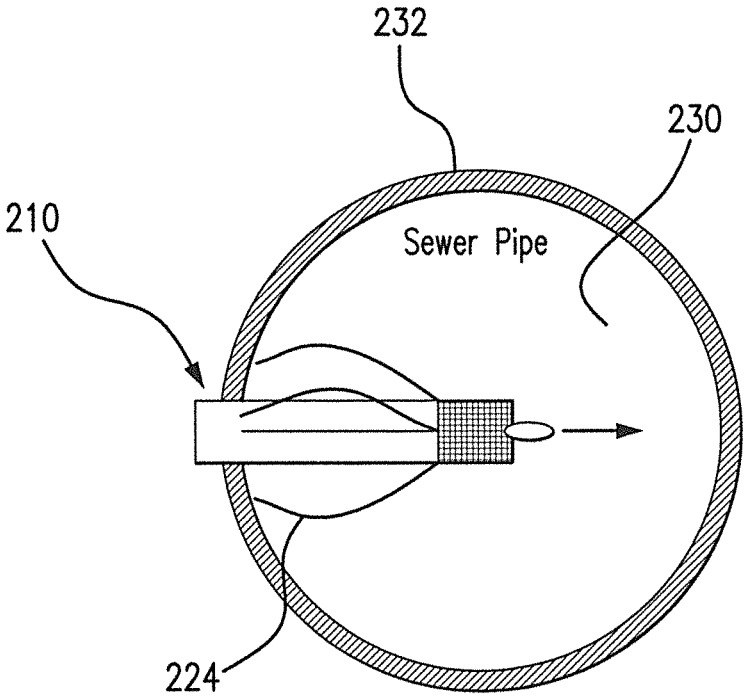
FIG. 4 is a simplified schematic diagram showing the underground cross-bore mechanical sensing device shown in FIGS. 2 and 3 but now with the device in an underground cross-bore, e.g., a sewer pipe.

Turning to FIGS. 2-4, there is illustrated, in simplified form, an underground cross-bore mechanical sensing device, generally designated by the reference numeral 210, in accordance with one embodiment of this invention.

As shown in FIG. 2, the mechanical sensing device 210 includes a main body portion 212 such as in the form of a cylindrical base having opposed first and second ends, 214 and 216. The main body portion 212 can, if desired, include or incorporate features such as to permit storage or transfer, electronically or otherwise, of signals or data obtained or gathered by the device 210.

The cylindrical base or body portion 212 can desirably be or have the same diameter as the HDD drill head or other desired underground travel element onto which the device 210 can desirably be mounted. In the illustrated embodiment, the first end 214 is open ended forming an open end 220 such as suitable for pipe end attachment of the device 210. The opposed second end 216 includes a pull ring 222, as further discussed below.

Adjacent the second end 216, the device 210 includes at least one mechanical arm 224. The movement of the arm 224 desirably can produce or result in an ON/OFF signal which can be stored or transmitted (wired or wireless) to the surface indicating the position of the mechanical arm.

While the mechanical sensing device 210 shown in FIGS. 2-4 includes 2 pairs of circumferentially spaced mechanical arms 224, it will be understood by those skilled in the art and guided by the teachings herein provided that the broader practice of the invention is not necessarily so limited as, for example, the invention can, if desired, be appropriately practiced with an embodiment wherein the device includes as few as one such arm. In other embodiments, mechanical sensing devices in accordance with the invention can include multiple such mechanical arms such as appropriately circumferentially spaced thereabout. For example, in other embodiments, devices in accordance with the invention include three and four pairs of mechanical arms, respectively.

The mechanical arms 224 are closed when the device 210 is in soil, as shown in FIG. 3, as the arms are restrained by the soil. The mechanical arms 224, however, are opened when the arms are not restrained, such as when in a void such as upon entry into an open area or cavity 230, such as formed by or resulting from the sewer pipe 232, as shown in FIG. 4.

As identified above, the movement of the arm(s) 224 desirably can produce or result in an ON/OFF signal which can be stored or transmitted (wired or wireless) to the surface indicating the position of the mechanical arm(s). An ON/OFF electronic signal can be sufficient to indicate if the apparatus has encountered a void such as representing a sewer lateral when some or all the springs are opened inside the sewer pipe. Further calibration of the sensor will filter false signals in soil and provide an indication of the size of the sewer line when the spring system is moved back in the soil.

Figure 5:
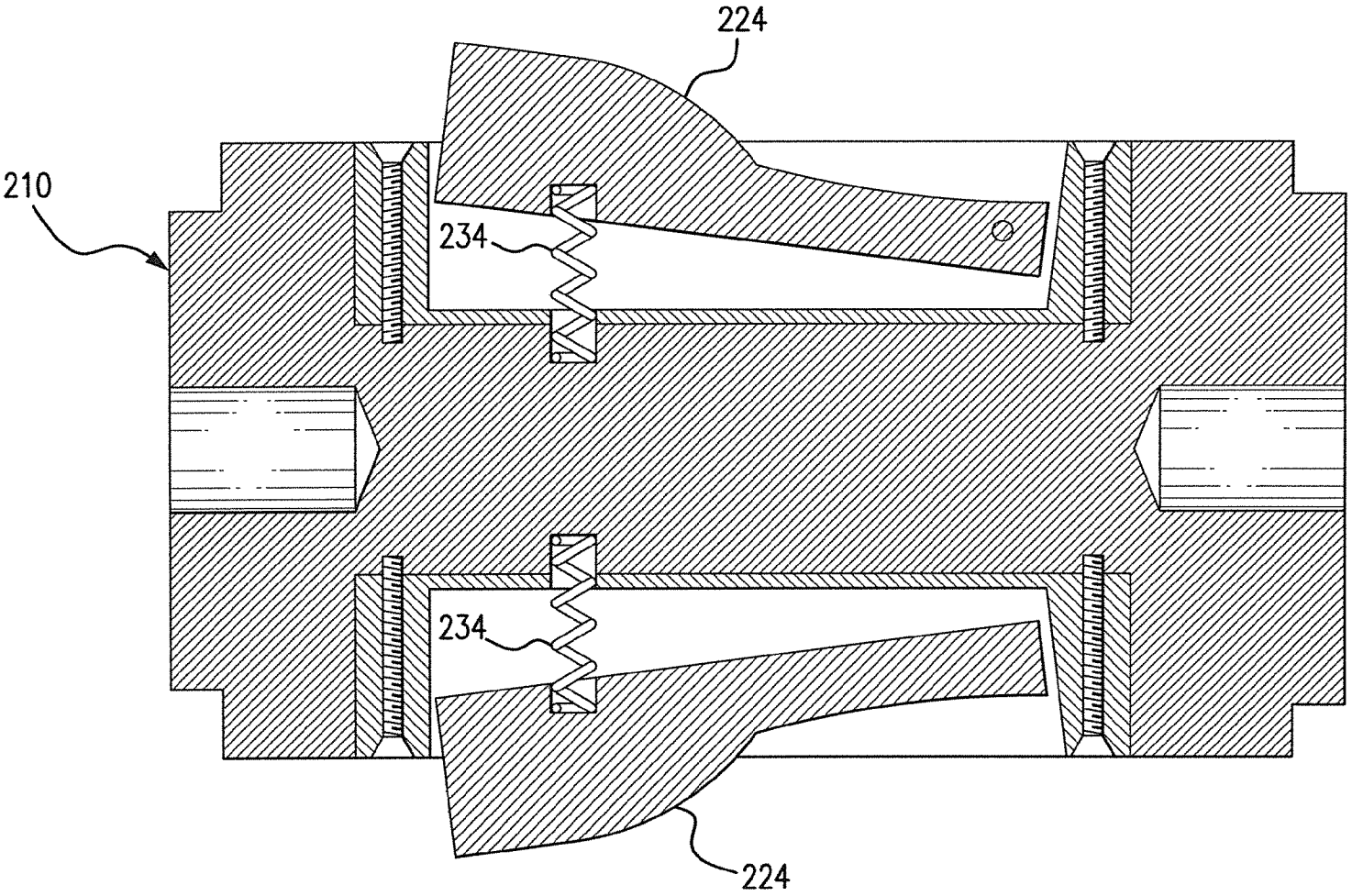
FIG. 5 is a simplified partially in section enlarged side view of an underground cross-bore mechanical sensing device in accordance with an embodiment of the invention and showing a pair of spring loaded mechanical arms.

For example, in the embodiment shown in FIG. 5, the arms 224 are opened and closed using springs 234 that are restrained in soil and allowed to open when in voids.

As further shown in FIG. 3 (but not shown in FIGS. 2 and 4), a membrane sleeve 236 can, if desired, be included externally disposed about at least a portion of the mechanical sensing device around the spring loaded mechanical arm(s) 224 such as to minimize or avoid complications such as due to surrounding soil or mud interfering with operation of the mechanical arms 224. Further the inclusion of such a membrane sleeve, such as formed of plastic or other suitable sheath material, can desirably facilitate the underground transportation or passage of the device 210 through the soil.

As identified above, the mechanical sensing device 210 may include or have associated therewith, such as in or as a portion of the main body 212, features such as to permit storage or transfer, electronically or otherwise, of signals or data obtained or gathered by the device 210. Such features in accordance with particular embodiments can, for example, include: one or more memory cards such as to record signals received from the mechanical sensing device, a transmitter to transmit signals from underground to aboveground such as to an aboveground receiver.

Figure 6:
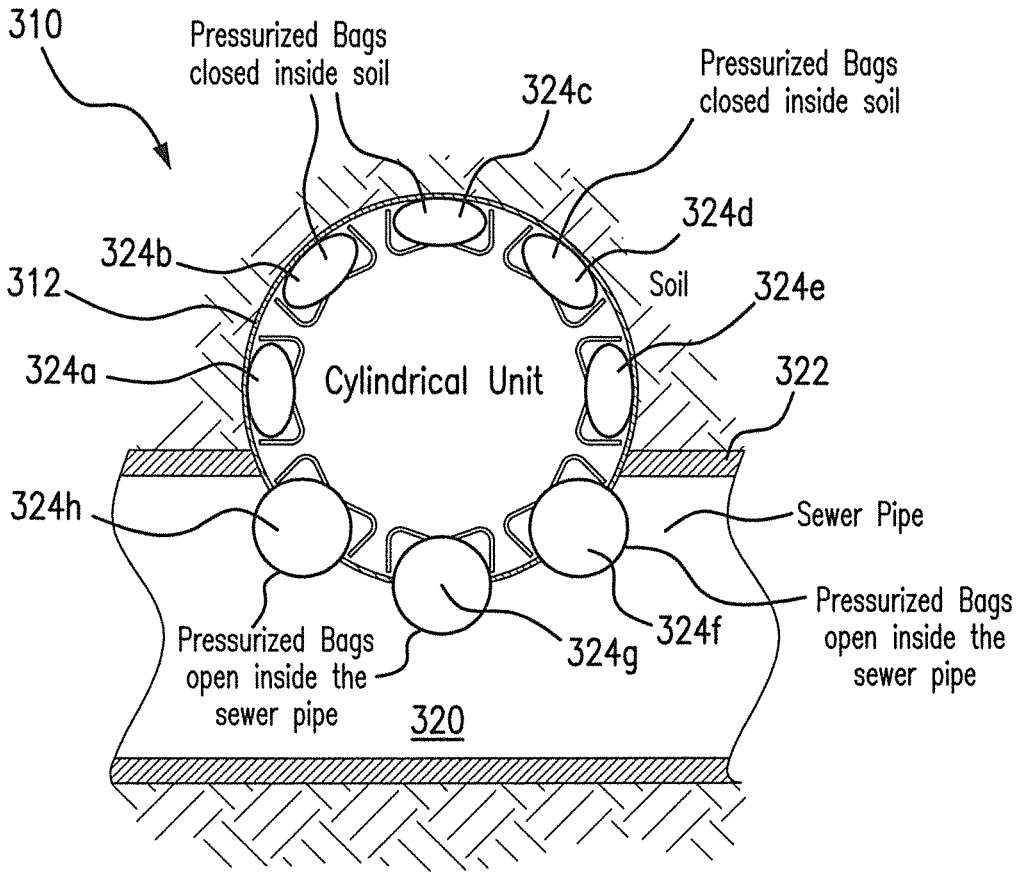
FIG. 6 is a simplified schematic diagram showing an underground cross-bore mechanical sensing device in accordance with another embodiment of the invention and with the device partially disposed in an underground cross-bore, e.g., a sewer pipe.

Turning now to FIG. 6, there is shown a simplified schematic diagram of an underground cross-bore mechanical sensing device, generally designated by the reference numeral 310, in accordance with another embodiment of the invention and with the device 310 partially disposed in an underground cross-bore 320, such as formed by a sewer pipe 322.

The underground cross-bore mechanical sensing device 310, rather than incorporating and relying on one or more mechanical arms instead includes at least one pressurized bag 324 appropriately disposed at or about a perimeter portion of the cylindrical base or main body 312 of the device 310 and which base can be attached or mounted to a selected underground travel element, such as described above. In the illustrated embodiment, the device 310 is shown as including eight such pressurized bags 324 evenly spaced about the perimeter of the cylindrical base. As with the mechanical arm-including embodiment of the device described above which can include various selected number of arms, such a pressurized bag-including device embodiment can include various selected number of pressurized bags.

As shown in FIG. 6, the pressurized bags 324*a-e* are appropriately closed or confined within the base 312 when confined or otherwise restrained by the soil and associated soil pressure. In contrast, the pressurized bags 324*f-h* that are exposed to the void or open area provided or resulting from the cavity 320 formed by the sewer pipe 322, expand or otherwise open. In practice, the pressure inside each of the bags can be appropriately calibrated to such that the bag opens when exposed to a cavity or open volume such as inside a sewer pipe and the bag remains closed in soil due to soil confining pressure.

In further specific embodiments, the pressure change in each bag as a result of exposure to a cavity or open volume such as the inside a sewer pipe desirably can produce or result in an ON/OFF signal which can be stored or transmitted (wired or wireless) to the surface and which signal can, if desired, also identify the specific pressurized bags which have expanded, e.g., are exposed to a cavity or open volume such as inside a sewer pipe.

Figure 7:
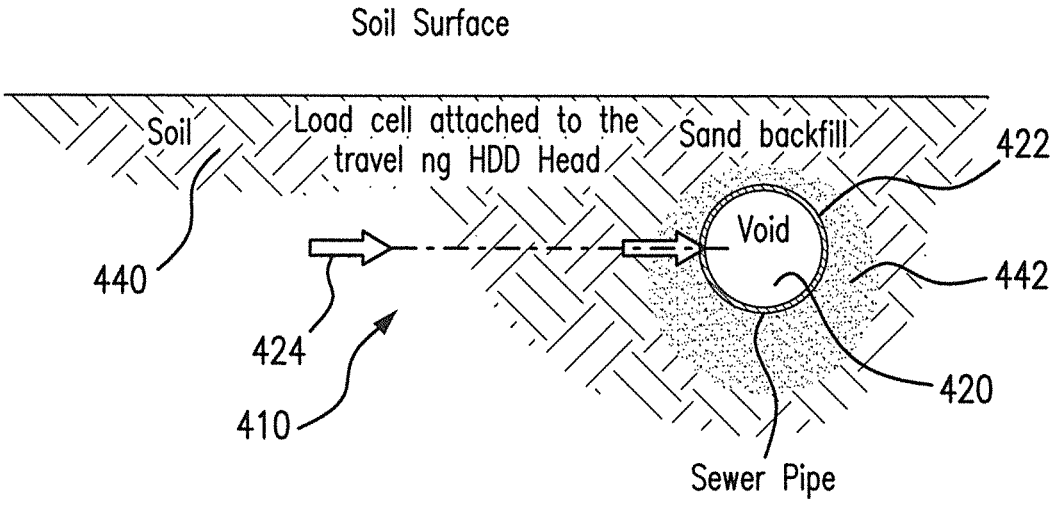
FIG. 7 is a simplified schematic diagram showing underground travel of an underground cross-bore load cell mechanical sensing device in accordance with another embodiment of the invention.

Turning now to FIG. 7, there is shown a simplified schematic diagram of an underground cross-bore mechanical sensing device, generally designated by the reference numeral 410, in accordance with another embodiment of the invention and with the device 410 partially disposed in an underground void 420 formed by the sewer pipe 422.

The underground cross-bore mechanical sensing device 410, rather than incorporating and relying on one or more mechanical arms 224 as with the above-described embodiment device 210 or one or more pressurized bags 324 as with the above-described embodiment device 310 instead includes a load cell 424 such as can be mounted to, on or with a selected underground travel element, such as mounted behind a drilling head, with the load cell 424 effective to monitor loads, such as the load required to break the wall of the sewer pipe. The load cell measurements will display a relatively high reading during the HDD or mole penetration through the wall, followed by a zero or near zero reading when the drill head does not meet resistance such as once exposed to the void or open area 420 such as the pipe cavity provided or resulting from the sewer pipe 422. The load cell measurements will display an intermediate reading during the HDD penetration through a sand backfill or the like 442, such as disposed about the underground pipe 422.

In practice, load cells for use in the measurement of soil resistance are commercially available in cone penetrometer test devices (CPT) where they provide "real time" data to characterize the soil resistance as the instrumented cone is driven into the soil.

Figure 8:
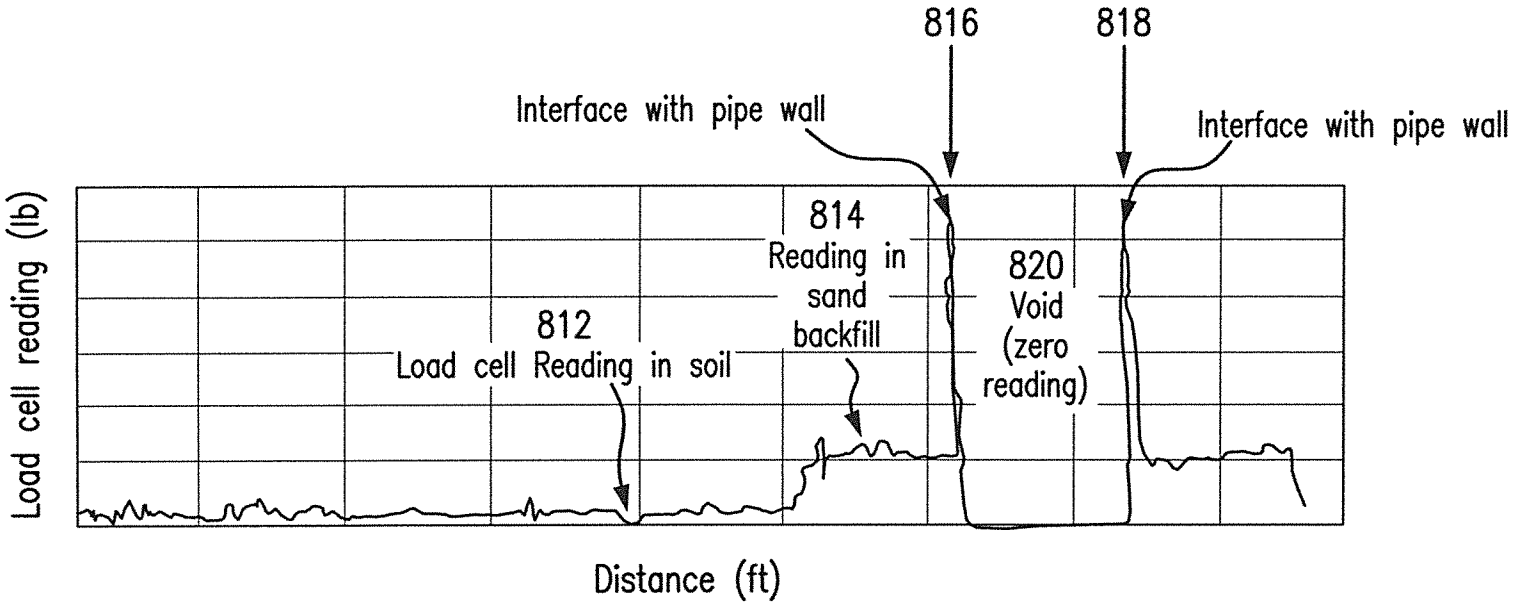
FIG. 8 is a graphical presentation of load cell reading versus distance for an underground cross-bore load cell mechanical sensing device such as shown in FIG. 7.

The pressure cell signal can be appropriately transmitted (wired or wireless) to a read out box at the surface. FIG. 8 is a graphical presentation of representative load cell readings versus distance for an underground cross-bore load cell mechanical sensing device such as shown in FIG. 7. More specifically, FIG. 8 depicts:

1. in section 812, the load cell readings associated with the load cell mechanical sensing device 410 traveling through the soil 440;
2. in section 814, the load cell readings associated with the load cell mechanical sensing device 410 traveling through sand or similar backfill material 442, such as may commonly be disposed about an underground pipe;
3. in sections 816 and 818, the load cell readings associated with the load cell mechanical sensing device 410 interfacing with the wall of the underground pipe 422; and
4. in section 820, the load cell readings associated with the load cell mechanical sensing device 410 being exposed to the void or open area such as provided or resulting from a sewer pipe cavity 420.

Those skilled in the art and guided by the teachings herein provided will appreciate that the invention can desirably provide or result in numerous and various advantages including, for example:

a. the ability to detect a hit or contact with an underground bore such as a pipe while drilling or during the pull back of the new pipe in HDD or mole installation;
b. generate or provide an output or signal of a simple ON/OFF form;
c. the device is a relatively low cost unit that can be integrated into existing HDD systems; and
d. operation does not require highly trained operators.

It will be appreciated that at least in selected embodiments, the mechanical sensing devices and methods of the invention serve to detect hits or contacts with underground bores, such as sewer pipes, only after a hit or contact with the particular underground bore. That is, in such embodiments, the devices and methods of the invention do not necessarily serve to prevent such hits or contacts. Nevertheless, such application of the mechanical sensing devices and methods of the invention can serve to allow the operator to remedy the situation and perform corrective actions; thereby preventing future potential incidents and reducing the percentage of hits which go undetected.

Moreover, the operation can with practice and use be appropriately calibrated such as to permit the ready identification of false signals such as may result from natural voids, such as may exist or be present in various soil formations. It will be further appreciated that wireless transmission of signals through the soil can be affected by the depth and soil type.

Moreover, through the ability to attach the mechanical sensing device of the invention to various underground travel elements such as, for example, a drilling head or a pipe during pullback, the invention presents a safe and economic solution to the need to detect incidents of pipe encroachments during HDD and mole operations.

In accordance with particular embodiments, mechanical systems of the invention are:

1. desirably sufficiently resilient such as to sustain the forces applied during the drilling and pullback operations;

2. spring loaded mechanical arm function properly in drilling mud and varying soil conditions, especially in the cohesive types encountered when operating in wet clay soil;
3. utilize electronics which are waterproof and preferably resistant to the chemical and environmental conditions such as may be encountered in the soil and cross-bore sewer lines;
4. utilize electronics designed to store or transmit signals in real time. Such a signal can, for example, be stored or transmitted utilizing a tracer wire as a communication line if it is installed during the operation or using a wireless radio transmission with automatic ON/OFF feature; and
5. the system is calibrated to identify false signals such as may result from passing through natural soil voids.

As will be appreciated by those skilled in the art and guided by the teachings herein provided, through the practice of the invention and the implementation of the cross-bore detection tool thereof, safety for homeowners can be improved and the installation of distribution gas lines in difficult areas where sewer lines intersect can be enhanced.

The invention illustratively disclosed herein suitably may be practiced in the absence of any element, part, step, component, or ingredient which is not specifically disclosed herein.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A method for detecting a pre-existing bore, said method comprising:

drilling a single horizontal bore without drilling lateral bores extending therefrom, the single horizontal bore having a substantially constant diameter;

determining whether the single horizontal bore has intersected the pre-existing bore, wherein the determining comprises:

transporting underground at least partially in a horizontal direction a combination of a mechanical sensing device attached to an underground travel element, the mechanical sensing device having at least two pairs of opposed extendible spring biased arms, the arms of each arm pair configured to be less than fully extended when the mechanical sensing device is in the single horizontal bore, each arm pair having a maximum extension of greater than the substantially constant diameter of the single horizontal bore;

sensing a first underground condition with the mechanical sensing device wherein the combination is ensconced in the single horizontal bore, the sensing of the first underground condition being indicated by the arm pairs being less than fully extended, and;

sensing a second underground condition wherein the mechanical sensing device identifies entry into the pre-existing bore by sensing an enlargement of the single horizontal bore in each of two directions, the two directions representing a first pre-existing bore portion and an opposed pre-existing bore portion, the enlargement in each of the two directions exceeding the maximum hole diameter represented by the fully extended arm pair aligned with such pre-existing bore portions, such that the enlargement is indicative of the continuous pre-existing bore.

* * * * *